US005391315A

United States Patent [19]

Ashkin

[11] Patent Number: 5,391,315

[45] Date of Patent: Feb. 21, 1995

[54] SOLID CAKE DETERGENT CARRIER COMPOSITION

[76] Inventor: Abraham Ashkin, 1330 Beech St., Terre Haute, Ind. 47804

[21] Appl. No.: 767,083

[22] Filed: Sep. 27, 1991

[51] Int. Cl.[6] ..... C11D 9/00

[52] U.S. Cl. ..... 252/108; 252/132; 252/550; 252/174.12; 252/DIG. 12; 252/DIG. 16

[58] Field of Search ..... 252/107, 108, 132, 174.12, 252/550, DIG. 16, DIG. 12

[56] References Cited

U.S. PATENT DOCUMENTS

| | | | |
|---|---|---|---|
| 3,536,628 | 10/1970 | Lancashire et al. | 252/117 |
| 4,190,549 | 2/1980 | Imamura et al. | 252/91 |
| 4,861,508 | 8/1989 | Wegener et al. | 252/121 |
| 4,874,538 | 10/1989 | Dawson et al. | 252/117 |
| 4,985,170 | 1/1991 | Dawson et al. | 252/117 |
| 5,300,249 | 4/1994 | Schwartz et al. | 252/108 |
| 5,312,559 | 5/1994 | Kacher et al. | 252/125 |

FOREIGN PATENT DOCUMENTS

| | | | |
|---|---|---|---|
| 6905168 | 10/1970 | Netherlands | 252/550 |
| 2110711 | 6/1983 | United Kingdom | 252/108 |

*Primary Examiner*—Gary P. Straub
*Assistant Examiner*—Timothy C. Vanoy
*Attorney, Agent, or Firm*—H. John Barnett

[57] ABSTRACT

A solid cake product containing soaps and detergents dispersed in a carrier system. The carrier system comprises 1–15% by total weight sodium stearate obtained from saponifying stearic acid; 1–20% by total weight of a fatty acid soap combined with the stearic acid in a ratio of about 2:1 to yield an average melting point in the range of about 35–50 deg. C. Other ingredients include ethoxylated or propoxylated non-ionic surfactants. Active agents, such as lauryl alkyl sulfate, sodium lauryl sulfate, and glycol may be included. A dampened sponge or cloth is wiped across the solid cake to pick up the cleaning agents, and is then applied to the article to be cleaned. The article and the sponge or cloth are then rinsed with hot water, and the cycle may be repeated on another article to be cleaned.

2 Claims, No Drawings

SOLID CAKE DETERGENT CARRIER COMPOSITION

BACKGROUND OF THE INVENTION

1. Field of the Invention

This invention pertains to a carrier composition for various soaps and detergents which is a solid cake at room temperature, but which can be dispensed from the solid cake by means of a wet sponge or cloth rubbed on the surface of the cake. A controlled amount of the cake, along with its soaps and detergents, dissolves on the wet sponge or cloth, and can then be transferred to the surface to be washed, such as a soiled dish or shirt collar.

2. Description of the Related Art

The following patents disclose various cleaning compositions:

| Patent Number | Inventor/Owner | Date |
|---|---|---|
| 3,949,137 | Akrongold et al | 1976 |
| 4,064,061 | Henry/Magi-Cloth | 1977 |
| 4,129,514 | Caffarel/Rhone-Poulenc | 1978 |
| 4,203,857 | Dugan/Colgate-Palmolive | 1980 |
| 4,207,198 | Kenkare/Colgate-Palmolive | 1980 |
| 4,448,704 | Barby et al/Lever | 1984 |
| 4,613,446 | Magyar/Pennzoil | 1986 |
| 4,615,819 | Leng et al/Lever | 1986 |
| 4,861,508 | Wegener et al/Henkel | 1989 |

Akrongold et al describes a gel-impregnated sponge, apparently used for bathing. Dugan is directed to a detergent-scrubber article which is impregnated with solid detergent. Suggested uses include washing dishes (Col. 13, ln. 48–54). Magyar's cleaning pads are used for whitewall tires, vinyl tops & trims, bumpers and other auto surfaces.

Leng et al discloses a detergent gel composition especially suitable for washing dishes. The gel is said to be more "aesthetically attractive" than opaque pastes based on ABS which are conventional dishwashing products in areas such as Turkey and the Middle and Far East (Col. 4, ln. 40–45). The product is apparently first dissolved in water (Example 27) when used for dishwashing. It is not clear how the opaque pastes are normally used in dishwashing.

None of the above patents appear to disclose a solid cake carrier/detergent composition. The concept of a solid paste dishwashing product is mentioned generally in Leng et al, but no solid cake composition like applicant's appears to be described.

SUMMARY OF THE INVENTION

The subject invention is directed to a solid cake product with a tertiary carrier system comprising 3–10% sodium stearate; 1–10% fatty acid soap in a ratio of about one part sodium stearate to two parts fatty acid soap; and up to about 20% by total weight of a highly ethoxylated fatty acid detergent. The above percentages are based on the total weight of the solid cake product, and the balance of the ingredients are selected for their particular properties.

Other ingredients, which are included to obtain particular properties when the product is formulated as a solid-hand dishwashing product, include active agents, such as 2–10% by total weight lauryl alkyl sulfate; 2–5% by total weight sodium lauryl sulfate; and 2–5% by total weight glycol. Pre-spotting agents, including fungicides, enzymes and abrasives are optional ingredients which are included when the product is to be used as a laundry pre-spotter, or as a heavy duty cleaning product.

The soap or detergent can be removed from the solid cake by means of a wet sponge or cloth, and the soap or detergent is then applied directly from the sponge or cloth to the soiled dish, shirt collar, or other article which requires cleaning. The cake is solid at room temperature, and does not dissolve if some water is left on it.

DESCRIPTION OF THE PREFERRED EMBODIMENT

The carrier composition is designed to provide a product which is a solid cake at room temperature, but which will release controlled amounts of active ingredients to a dampened sponge or cloth when the sponge or cloth is rubbed on the solid cake surface. At the present time, the carrier comprises about 1–15% by total weight sodium stearate obtained from saponifying stearic acid, preferably 3–12% by total weight; about 1–20% by total weight of a fatty acid soap, preferably 3–15% by total weight, combined with the stearic acid in a ratio of about 2:1 and saphonified at an elevated temperature in an aqueous alkali medium to yield an average melting point between 35–50 deg. C.; and about 1–30% by total weight of a non-ionic surfactant, preferably 5–20% by total weight, the non-ionic surfactant having the general formula R-(R')nOH, in which R is a C6-C20 alkyl group, R' is a polyoxy of ethylene or propylene, or a combination thereof; and n is greaterthan 9 and as high as 30. Typical of these non-ionic surfactants are the "Pluronics" and "Tetronics" compounds made by BASF Corporation, Parsippany, N.J. Most desirable is a range of ethoxylation up to about 15% by weight of ethylene oxide. "Pluronics" surfactants which are useful for this invention include F 68, F 77, F 87 and F 88. BASF "Tetronics" surfactants which may be used include Numbers 908 and 1107.

The presently preferred carrier composition comprises about 5% stearic acid, 10% fatty acid soap and about 5% non-ionic surfactant, all based on the total weight of the solid cake product. The balance of the product comprises active agents such as lauryl alkyl sulfate, sodium lauryl sulfate and glycol.

The hand dishwashing product may include about 2–10% by total weight lauryl alkyl sulfate; about 2–5% by total weight sodium lauryl sulfate; and about 2–5% by total weight glycol. Dyes and perfumes may be included as required to obtain the desired aesthetic properties for the product.

The combination of carrier and active ingredients are mixed at an elevated temperature, and are poured in the liquid, flowable state into wide-mouthed, shallow plastic tubs. The liquid containing tubs are then cooled to solidify the carrier-detergent mixture into a solid cake.

The plastic container is provided with a plastic lid when the product is not in use. When the solid cake is used as a dish washing agent, a dampened sponge or cloth is rubbed across the top of the cake to pick up a small amount of cleaning compound. The dampened sponge or cloth containing the cleaning compound is then applied to the soiled dish to wet and remove the soil. The dish and sponge are then both rinsed separately with hot water, and the process can be repeated on another soiled dish.

There is a great saving in water, the energy to heat the extra water, and there is no wasted detergent. Only the minimum amount of detergent necessary to remove the soil on the dishes is used because the dishes need not be immersed in hot water saturated with excess detergent.

The solid cake remains solid, even after repeated use, and does not soften, even if excess water remains on the surface, as is the case with most hand soap cakes or bars. The pickup of active ingredients is somewhat more effective if the dampened sponge or cloth is dampened with hot water.

The solid cake product is especially convenient for doing a small quantity of dishes, and it is convenient for camping trips, recreational vehicle use, and any situation where only a few dishes require handwashing. The carrier composition is biodegradable, and the active agents may be selected to be biodegradable, also.

The solid cake product may be formulated for many other uses. For example, it may be used as a basin, tub and tile cleaner by including a mild abrasive and pine solvent. Using a lesser amount of stearic acid will make the cake softer so the damp sponge or cloth will more readily pick up the abrasive compounds.

The product can be formulated for use as a heavy duty tile cleaner by including either peroxide or phenolic cleaning compounds, or combinations of these compounds, which are available from Dow Chemical Corporation, Midland, Mich. Only the necessary amount of these heavy duty cleaners is applied to the tile, and the cleaner is then rinsed away with the soil and stains, thereby reducing the load on the sewage disposal system.

For a laundry pre-spotter compound, enzymes for dissolving stains are included, such as protease for protein stains. Optional bleaching compounds, such as sodium hypochlorite, may be included. For this application as a laundry pre-spotter, it is desirable to reduce the percentage by weight of sodium stearate in the carrier composition to give a softer, more spreadable product.

The solid cake product may also be used as a metal cleaner by incorporating cleaning agents for stainless steel, copper and silver into the solid cake. For use on polished metal, it is important that the product contain no abrasives.

The solid cake product may also be readily modified for use as a whitewall tire cleaner. A bleaching agent, such as sodium perborate, may then be included. Sodium perborate gives a longer shelf life for products requiring a bleach, such as a whitewall tire cleaner, which are used sporadically.

I claim:

1. A solid cake cleaning product disposed in a shallow plastic tub, comprising up to about 6 to 20 weight per cent active agents;

5–20 weight per cent non-ionic surfactant of the general formula R-(R′)n OH, in which R is C6-C20 alkyl group, R′ is a polyoxy of ethylene or propylene, or a combination thereof, and n is an integer greater than 9 and as high as 30;

3–10 weight per cent sodium stearate; and

3–15 weight per cent of a fatty acid soap other than sodium stearate, said solid cake cleaning product containing no more than about 40 weight per cent of solids in an aqueous alkali medium, being sparingly soluble in cold water at room temperatures, and having an average melting point in the range of 35–50 degrees C., said solid cake cleaning product being capable of releasing effective amounts of active agents onto a dampened cloth or sponge when rubbed thereby, with no change in the solubility level of the solid cake cleaning product.

2. A cleaning product which is a sparingly soluble solid cake of about 35 weight per cent solids in an aqueous alkali medium, comprising:

about 10 weight per cent active cleaning agents;

about 5 weight per cent non-ionic surfactant;

about 10 weight per cent sodium stearate; and about 10 weight per cent fatty acid soap other than sodium stearate dispersed in an aqueous alkali medium, said cleaning product being particularly adapted for repeated use with a dampened sponge rubbed on the surface of the cake, and the cleaning product remains solid even when excess water remains on the surface of the solid cake between periodic uses to clean dishes with the dampened sponge.

* * * * *